US005233901A

United States Patent [19]

Nilsson et al.

[11] Patent Number: 5,233,901

[45] Date of Patent: Aug. 10, 1993

[54] ROLL ANGLE DETERMINATION

[75] Inventors: Berndt Nilsson, Karlskoga; Åke Hansén, Karlstad, both of Sweden

[73] Assignee: AB Bofors, Bofors, Sweden

[21] Appl. No.: 674,958

[22] Filed: Mar. 26, 1991

[30] Foreign Application Priority Data

Mar. 15, 1990 [SE] Sweden ..... 9000917-6

[51] Int. Cl.[5] ..... F42C 17/00

[52] U.S. Cl. ..... 89/6.5; 73/167

[58] Field of Search ..... 89/14.05, 6, 6.5; 244/3.21, 3.23, 3.11, 3.15; 73/167

[56] References Cited

U.S. PATENT DOCUMENTS

| | | | |
|---|---|---|---|
| 2,603,970 | 7/1952 | Metzler et al. | 89/6.5 |
| 3,659,201 | 4/1972 | Vogelsang | 73/167 |
| 3,765,621 | 10/1973 | Shigehara | 244/3.21 |
| 4,022,102 | 5/1977 | Ettel | 89/6.5 |
| 4,080,869 | 3/1978 | Karayannis et al. | 89/6.5 |
| 4,457,206 | 7/1984 | Toulios et al. | 244/3.14 |
| 4,483,190 | 11/1984 | Cornett | 102/209 |
| 4,750,689 | 6/1988 | Yff | 244/3.21 |
| 4,967,981 | 11/1990 | Yff | 244/3.21 |
| 5,099,246 | 3/1992 | Skagerlund | 244/3.14 |

FOREIGN PATENT DOCUMENTS

| | | | |
|---|---|---|---|
| 319649 | 6/1989 | European Pat. Off. . | |
| 890521 | 2/1944 | France | 244/3.21 |

*Primary Examiner*—Stephen M. Johnson

*Attorney, Agent, or Firm*—Pollock, Vande Sande & Priddy

[57] ABSTRACT

An apparatus for determining the roll angle of a rotating projectile, shell, missile or the like as it leaves the barrel or launch tube includes a magnetized part with a known polarization direction provided in the projectile, and two pairs of windings mounted at the very front of the muzzle bell of the barrel in such a way that a voltage is induced in the windings when the projectile passes the mouth, and an evaluation unit is designed to calculate, based on the voltage signals, the roll angle position of the projectile upon firing.

7 Claims, 4 Drawing Sheets

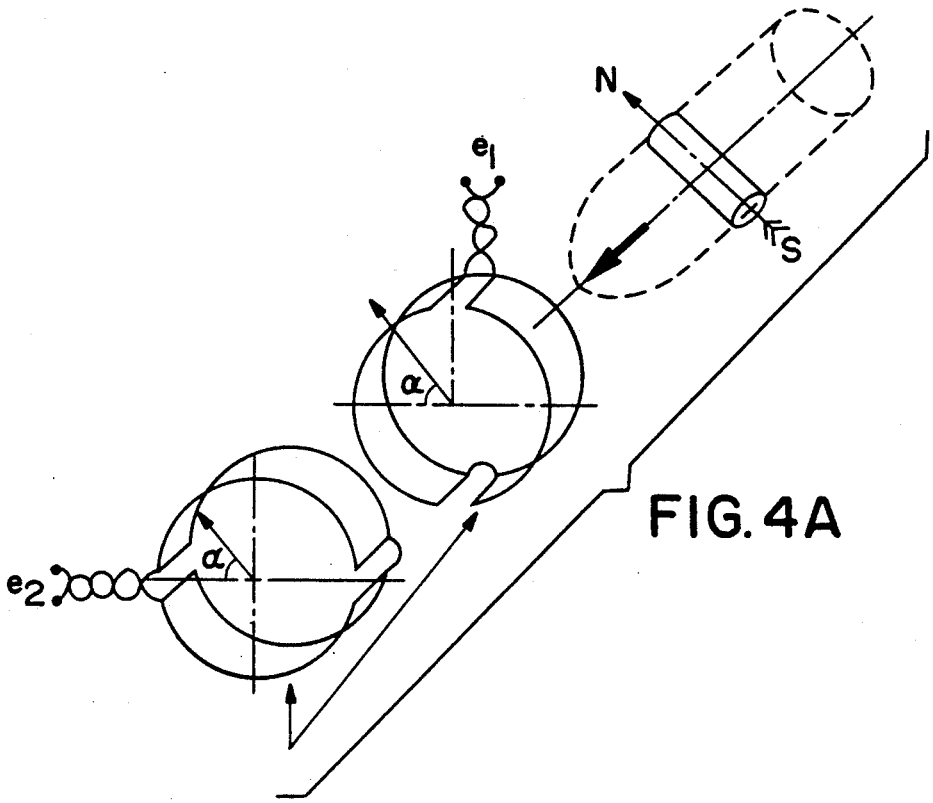
FIG. 4A
FIG. 4B
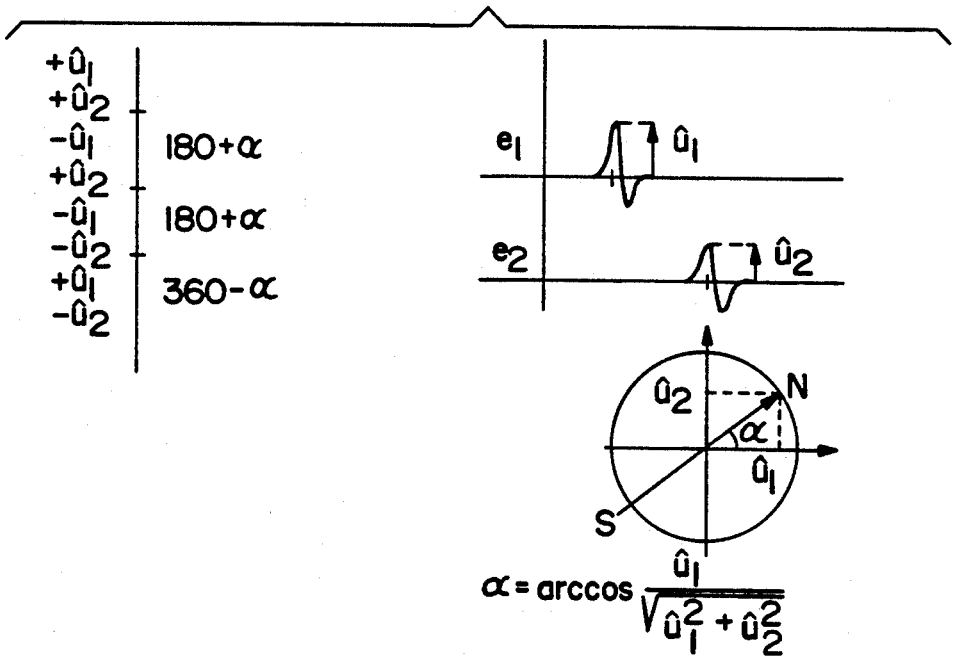

ROLL ANGLE DETERMINATION

FIELD OF THE INVENTION

The present invention relates to an apparatus for determining the roll angle of a rotating projectile, missile or the like by magnetic means as it leaves the barrel, launch tube or the like.

The invention is applicable to all types of projectiles, missiles or the like which are fired from a barrel or launch tube and which rotate in their trajectory. The invention can be used in particular in so-called terminal-stage-guided ammunition, i.e. projectiles which are fired in a conventional manner in a ballistic trajectory to the immediate vicinity of the target, where they receive a command for necessary correction. Due to the fact that the projectile rotates in its trajectory, its roll position must be determined when the command is executed. In the absence of members for determining the roll position, an error otherwise occurs in the course correction.

BACKGROUND OF THE INVENTION

It is already known from U.S. Pat. No. 5,099,246 to determine the roll angle position with the aid of polarised electromagnetic radiation, comprising a transmitter arranged to emit a polarized radiation in the direction towards the projectile and a polarization-sensitive receiver arranged in the projectile. By having the emitted polarized radiation consisting of at least two mutually phase-locked radiation components with a wavelength ratio of 2:1 and/or multiples thereof, which are superposed and form an asymmetrical curve shape, the roll position of the projectile can be unambiguously determined.

In abovementioned apparatus that a transmitter is placed in connection with the launching position of the projectile and the projectile is provided with a rearward-directed receiving antenna in order to receive the transmitted radiation.

Although an apparatus of the type described permits an unequivocal determination of the roll position with satisfactory precision and without ambiguity, it can be a disadvantage to be dependent on two mutually phase-locked frequencies since both the transmitter and receiver become more complicated.

It is also already known to determine the roll angle position by magnetic means by sensing the earth's magnetic field, see EP 0 319 649. Such a system is, however, latitude-dependent and sensitive, to interference.

SUMMARY OF THE INVENTION

The aim of this invention is to provide an alternative to the methods described above for roll angle determination, in which the determination is carried out by magnetic means instead of with transmitted microwave radiation, and without being dependent on the earth's magnetic field.

An embodiment of the preset invention is shown diagrammatically in the attached drawings, in which:

BRIEF DESCRIPTION OF THE DRAWINGS

FIGS. 4A and B show diagrammatically how an induced voltage is generated as the projectile passes the winding.

DETAILED DESCRIPTION OF THE PREFERRED EMBODIMENT

Figure 1:
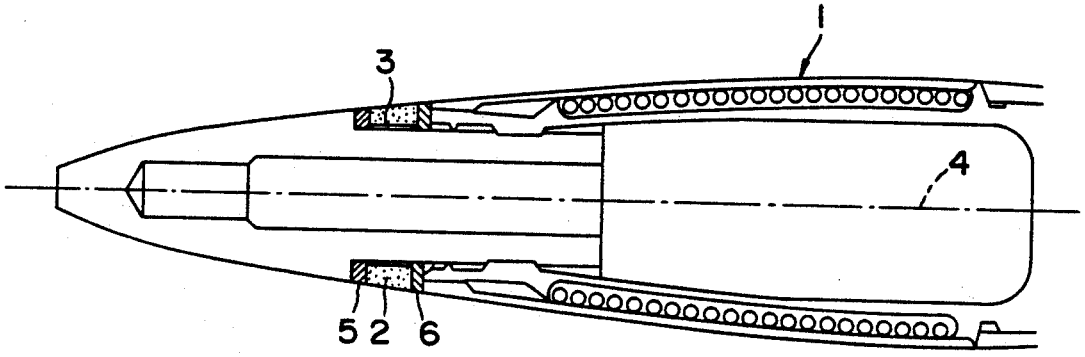
FIG. 1 shows a projectile (ballistic high-explosive shell) provided with a permanent magnet.
Figure 2A:
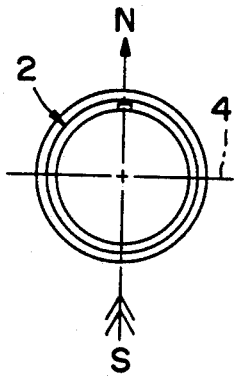
FIGS. 2A and B show the magnetic field orientation.
Figure 2B:
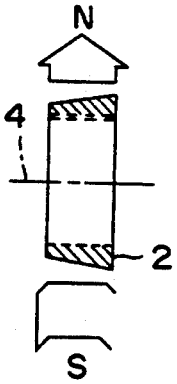

FIG. 1 shows a projectile in the form of a ballistic high-explosive shell 1, intended to be fired in a conventional manner from a barrel. A circular permanent magnet 2 is mounted in a wedge-shaped groove 3 in the nose cone casing of the shell in such a way that the magnetic field is oriented transverse to the longitudinal direction 4 of the shell, see FIG. 2. The position of the permanent magnet 2 is chosen by taking into consideration the temperature and acceleration stresses. The magnet can be of ferrite material and magnetized upon assembly. The magnet is assembled in a fixed position in the rolling plane so that correct angle information will be obtained (see below), in which respect an antenna in the rear plane of the shell may constitute a reference. Two non-magnetic rings 5, 6 are arranged in front of and behind the permanent magnet. The shell is in other respects conventional and is therefore not described in greater detail.

Figure 3A:
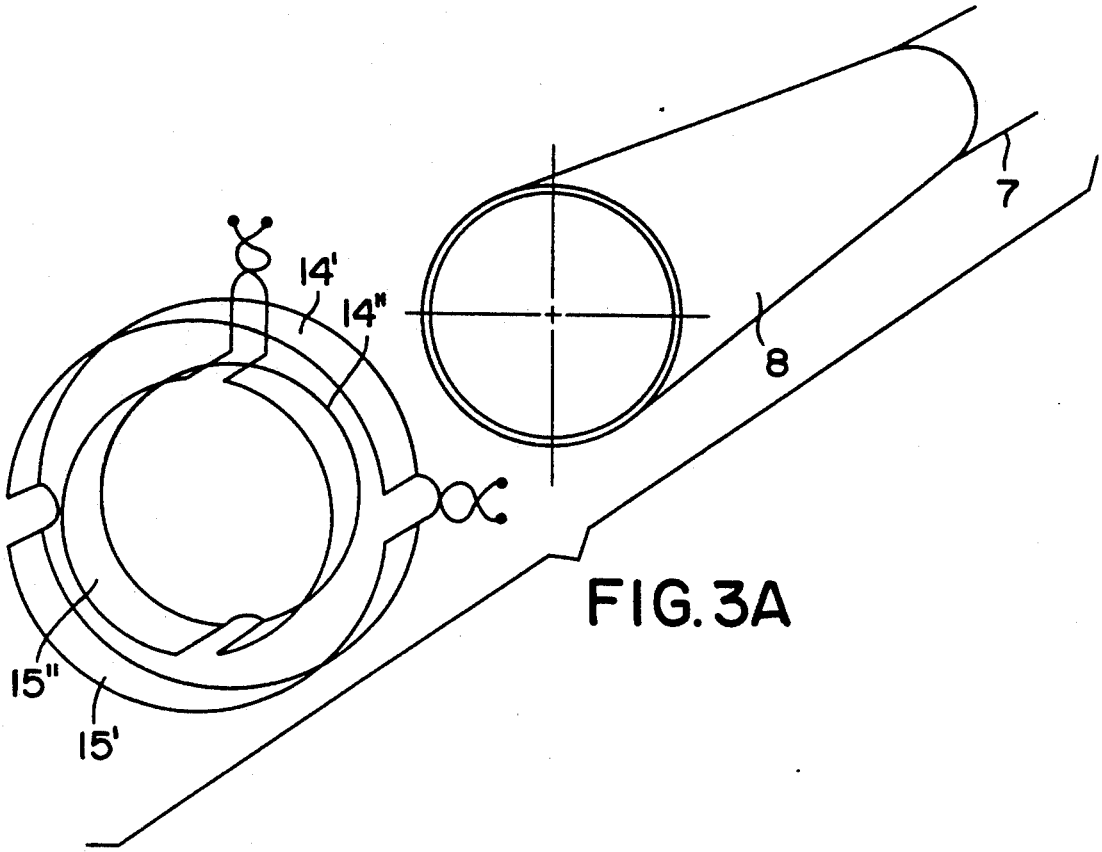
FIGS. 3A and B show a gun barrel muzzle bell provided with two pairs of windings in an exploded and cross sectional view, respectively.
Figure 3B:
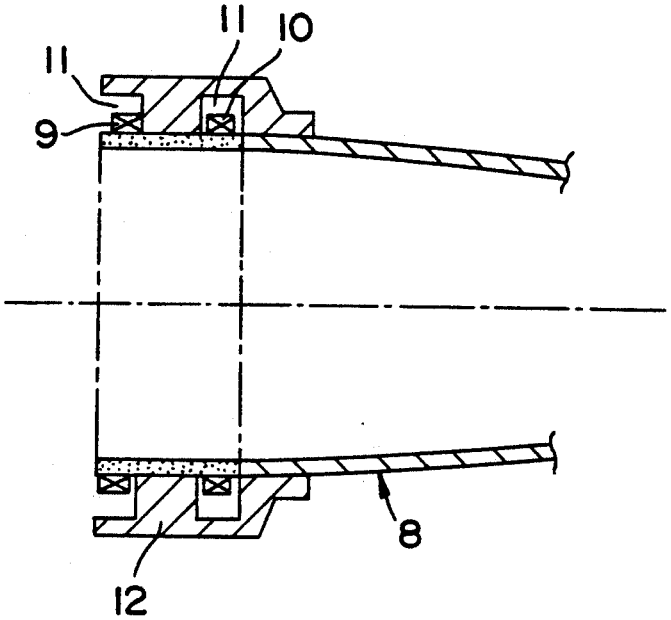
Figure 5A:
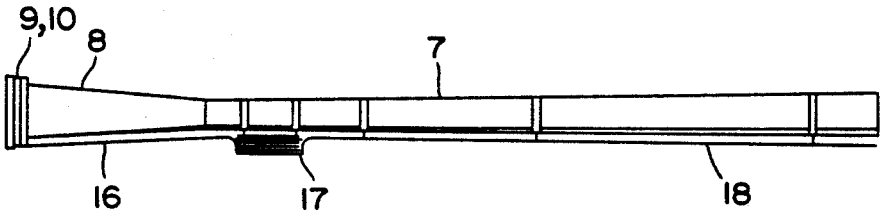
FIGS. 5A and B show positioning of an evaluation unit with respect to the barrel, and an example of an evaluation unit for the sensor signals.
Figure 5B:
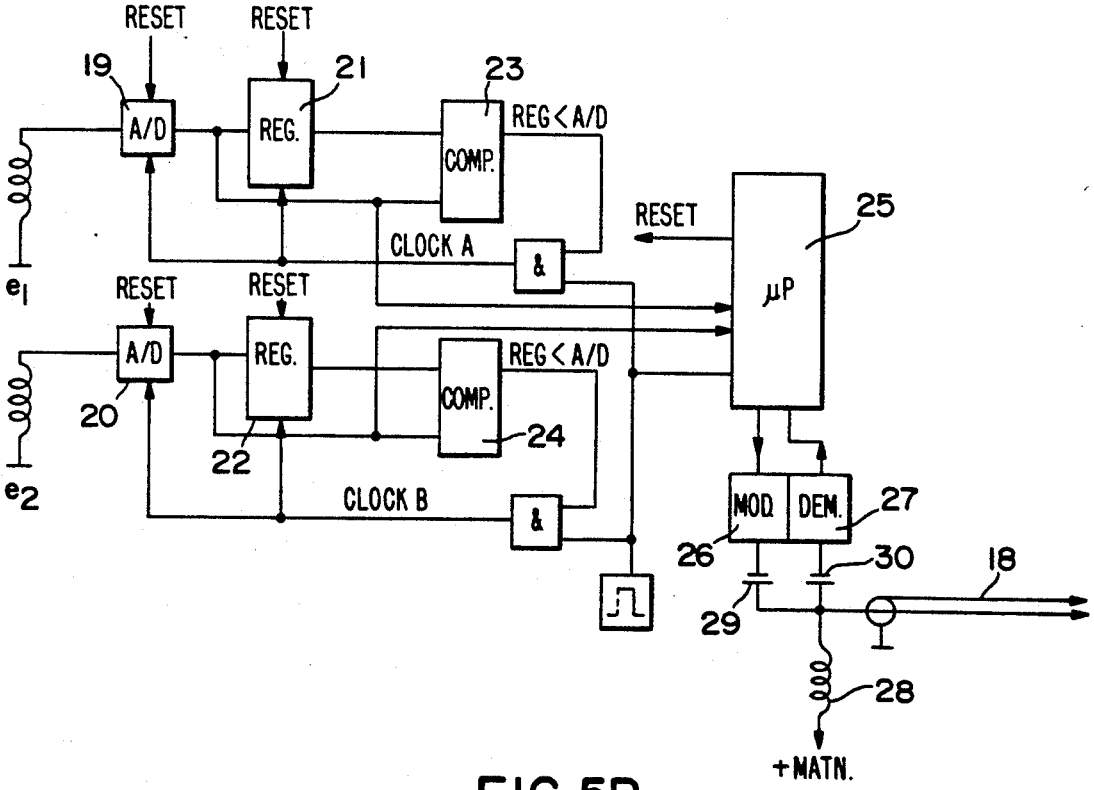

As shown in FIGS. 3 and 5 the mouth of the gun barrel 7 is equipped with a muzzle bell 8 in the form of a truncated cone. Two pairs of windings 9, 10 are mounted on the outermost part of the muzzle bell, each pair of windings 9, 10 consisting of two series-coupled windings 14', 15' and 14", 15" placed on each side of the projectile trajectory.

As the shell passes the two pairs of windings, a voltage is induced in the windings and, by means of suitable signal processing, the roll angle of the shell upon passage through the mouth can be determined. The roll angle information is conveyed to a central unit, from which the angle information and time after firing can be conveyed to the projectile via a command link. By means of suitable electronics, the projectile can then calculate the actual rotation position from this information. These parts including central unit, command link and projectile electronics do not however constitute part of this invention and are therefore not described in greater detail.

The pairs of windings are expediently arranged in their respective grooves 11 in a circular retainer 12 mounted at the very front of the muzzle bell. The windings themselves are designed as rectangular coil members 14', 15'and 14", 15" which are shaped to follow the curve of the muzzle bell, see FIG. 3. non-conductive and non-magnetic material is used as a base for the mounting of the windings, and the material will additionally be resistant to temperature and acceleration shocks.

When the projectile with its magnet passes the windings, e.m.f.'s in accordance with FIG. 4 are induced according to the formula:

$$\hat{e} = N \cdot \frac{d\phi}{dt} \; [V]$$

where $\hat{e}$=induced voltage in volts
N=number of turns on winding $$\frac{d\phi}{dt} = \text{flux alteration per time unit.}$$

For winding 1 and 2, the following applies:

$$\hat{e}_1 = K \cdot V_o \cdot \cos\alpha \text{ resp. } \hat{e}_2 = K \cdot V_o \cdot \sin\alpha \text{ [V]}$$

where
K=constant depending on the design of the winding and the dipole moment of the magnet
$V_o$=initial velocity of projectile $$\left(\frac{d\phi}{dt} \sim V_o\right)$$

$\alpha$=angle to the centre line of the windings.
As the windings are turned 90° relative to each other, the induced voltage peaks lie in relation to each other in the ratio $\sin\alpha/\cos\alpha$, which gives:

$$\hat{e}_1 = K \cdot V_o \cdot \cos\alpha \text{ [V]}$$

$$\hat{e}_2 = K \cdot V_o \cdot \sin\alpha \text{ [V]}$$

The following derivation shows how K and $V_o$ are eliminated:

$$\frac{\hat{e}_1}{(\hat{e}_1^2 + \hat{e}_2^2)^{\frac{1}{2}}} = \frac{\hat{e}_1}{(K^2 \cdot V_o^2 \cdot \sin^2\alpha + K^2 \cdot V_o^2 \cdot \cos^2\alpha)^{\frac{1}{2}}}$$

$$\frac{K \cdot V_o \cos\alpha}{K \cdot V_o \cdot 1} = \cos\alpha$$

$$\text{i.e. } \alpha = \arccos \frac{\hat{e}_1}{(\hat{e}_1^2 + \hat{e}_2^2)^{\frac{1}{2}}}$$

The ambiguity in the arc cos function is eliminated by studying the signs of $e_1$ and $e_2$.

An estimate of the voltage induced in a winding has been made, in which $\hat{e}$=2.6 mV/turn.

For an A-D converter with 8 bits and 5 mV resolution the following is required:

$$N = \frac{256 \cdot 5 \cdot 10^{-3}}{2 \cdot 2,6 \cdot 10^{-3}} = 246$$

where N=the number of turns in a pair of windings.

The voltages $\hat{e}$ (sensor signals) induced in the windings 9, 10 are conveyed via cabling 16 to an evaluation unit 17 (see FIG. 5) situated on the barrel 7 in the vicinity of the mouth and advantageously suspended in a shock-absorbing manner. Voltage feed and two-way transmission to a central unit (not shown) is via a common coaxial cable 18, adapted for high transmission speed.

The evaluation unit 17 comprises two A-D converters 19, 20, registers 21, 22 and comparators 23, 24 connected to a microprocessor 25 for calculating the angle value $\alpha$. The microprocessor 25 is connected via a MODulator 26 to the central unit via the coaxial cable 18.

The function of the evaluation unit 17 is as follows. Immediately before firing, the A-D converters 19, 20 and the registers 21, 22 are reset. Clock signals CLOCK A and CLOCK B sample the A-D converters at a considerably higher frequency than the highest component frequency in the measurement signal (over-sampling). When the measurement signals appear, the analog signals are converted to digital quantities and are clocked over to the digital registers 21, 22 with a clock pulse displacement. When the comparators 23 and 24 detect that the register values are greater than the value just converted in the A-D converter 19 and 20, CLOCK A or CLOCK B is blocked. The peak value now lies stored in register 21 or 22 and can be input to the microprocessor 25 for evaluation.

The value calculated in the microprocessor 25 is transmitted in a serial form via the MODulator 26 to the central unit (not shown) via the coaxial cable 18. The control command to the microprocessor 25 can also be transmitted from the central unit via a DEModulator 27. The supply voltage to the evaluation unit 17 is dealt with by the central unit with the aid of the cable 18. The voltage is applied to the electronics with the aid of a choke 28. The modulated signal is blocked at its frequency by the choke, and the coupling capacitors 29 and 30 on DEM and MOD block the d.c. level on cable 18.

We claim:

1. An apparatus for determining a roll angle of a rotating projectile leaving a barrel of a gun upon firing said apparatus comprising a magnetized part with a known polarization direction provided in the projectile, at least two pairs of windings assembled in connection with the barrel such that a voltage is induced in the windings when the projectile passes a mouth of the barrel and an evaluation unit for receiving induced voltage signals and for calculating based on said voltage signals, said roll angle of the projectile upon firing.

2. An apparatus according to claim 1, wherein said magnetized part comprises a permanent magnet which is assembled in the projectile in such a way that its magnetic field is oriented transverse to a longitudinal direction of the projectile.

3. An apparatus according to claim 2, wherein the permanent magnet is circular and arranged in a groove in a nose cone casing of the projectile in a plane perpendicular to the longitudinal direction of the projectile.

4. An apparatus according to claim 1, wherein each pair of said windings includes two series-coupled windings placed such as to be on each side of the passing projectile and at a 90° angle relative to each other.

5. An apparatus according to claim 4, wherein the windings in each pair of windings are in the form of rectangular coils which are bent to follow a curved shape of a muzzle bell of the barrel.

6. An apparatus according to claim 5, wherein said pairs of windings are arranged in a respective groove in a circular retainer mounted at a forward most area of a muzzle bell of the barrel.

7. An apparatus for determining a roll angle of a rotating projectile leaving a barrel of a gun upon firing, said apparatus comprising:

a magnetized part with a know polarization direction provided in the projectile, at least two pairs of windings assembled in connection with the barrel such that a voltage is induced in the windings when the projectile passes a mouth of the barrel, and an evaluation unit for receiving voltage signals and for calculating, based on said voltage signals, said roll angle of the projectile upon firing; and wherein said evaluation unit includes an A/D converter for converting analog signals to digital signals, comparators for evaluating said digital signals by comparing them with register signals, and a microprocessor for calculation of said roll angle based on signals received from said comparators.

* * * * *